US007458488B2

(12) United States Patent
Bass et al.

(10) Patent No.: US 7,458,488 B2
(45) Date of Patent: Dec. 2, 2008

(54) PORTABLE CARRYING DEVICE WITH RETRACTABLE STRAP

(76) Inventors: Robert Bass, 1141 NE. 26th Ave., Ft. Lauderdale, FL (US) 33062; John Bass, 1141 NE. 26th Ave., Ft. Lauderdale, FL (US) 33062

( * ) Notice: Subject to any disclaimer, the term of this patent is extended or adjusted under 35 U.S.C. 154(b) by 0 days.

(21) Appl. No.: 11/649,437

(22) Filed: Jan. 3, 2007

(65) Prior Publication Data

US 2007/0108241 A1 May 17, 2007

Related U.S. Application Data

(63) Continuation of application No. 10/652,455, filed on Aug. 29, 2003, now abandoned.

(51) Int. Cl.
*B65H 75/40* (2006.01)

(52) U.S. Cl. ..... 224/162; 224/600; 224/268; 224/269

(58) Field of Classification Search ..... 224/917.5, 224/162, 159, 268, 269, 600; 150/108; 190/108
See application file for complete search history.

(56) References Cited

U.S. PATENT DOCUMENTS 3,423,044 A * 1/1969 Beiderwell ..... 242/396.9
3,805,929 A * 4/1974 Kuwayama ..... 190/18 A
4,194,315 A * 3/1980 Martin et al. ..... 43/55
5,294,029 A * 3/1994 Shimura et al. ..... 224/162

* cited by examiner

*Primary Examiner*—Tri M Mai
(74) *Attorney, Agent, or Firm*—Darby & Darby; Robert J. Sacco

(57) ABSTRACT

The invention is directed to a portable carrying device that includes a housing, an elongated flexible strap extendable from the housing, and at least one rigid support arm attached to the housing and configured for supporting an article to be carried. The portable carrying device can include a coupler disposed on a first end of the elongated flexible strap and a mating structure disposed on a portion of the housing for releasably securing the coupler. The rigid support arm can be movable from a first position in which the rigid support arm is compactly stored relative to the housing, to a second position in which the rigid support arm is at least partially extended away from the housing. The housing can have at least one recess for receiving the rigid support arm and the rigid support arm can have a shape corresponding to the recess.

11 Claims, 12 Drawing Sheets

PORTABLE CARRYING DEVICE WITH RETRACTABLE STRAP

BACKGROUND OF THE INVENTION

This Application is a Continuation to U.S. patent application No. 10/652,455 filed Aug. 29, 2003.

TECHNICAL FIELD

This invention relates generally to the field of portable carrying devices, and more particularly, to compactable portable carrying devices.

DESCRIPTION OF THE RELATED ART

Individuals commonly need to carry a variety of objects; however, there is a limit to how many objects that can be comfortably grasped with an individual's hands. To overcome this limit, many devices have been constructed to increase the number of objects that an individual can carry. Suitcases have been designed for orderly storing multiple items. However, suitcases are usually bulky and not convenient for toting along on a daily basis. As another example, backpacks allow an individual to store multiple items on the individual's back and leave the hands free for grasping other items. While back packs offer one solution, they also create another problem similar to other attempted solutions. The individual must carry the bulky backpack prior to use, and similar to suitcases, backpacks may not be convenient for toting along on a daily basis. Additionally, backpacks of any useful size cannot easily be stored as most backpacks are not configured to fold into a compact unit.

Traditional brown paper bags allow shoppers to carry multiple items, from a grocery store for example, without having to hold each item individually with the shopper's hands. Additionally, brown paper bags are easily folded into a compact state that allows easy storage. While brown paper bags can be easily stored and can ease the burden of carrying multiple items, a common disadvantage of brown paper bags is that they require a shopper to use both hands and arms to securely support the brown paper bag.

An improvement over the traditional brown paper bag is a plastic bag with integrated handles. Such plastic bags allow individuals to comfortably carry multiple items within the bag by using only the hand to grasp the handles. Plastic bags are either easily stored or simply thrown away. Nevertheless, plastic bags with handles still have limitations. For example, while a lightweight plastic bag can be easy to carry by hand, carrying a heavy plastic bag by hand can be uncomfortable and even painful. The weight of the bag can cause the bag's handles to apply a significant amount of pressure to the individual's hand. This problem is greatly exacerbated when the individual is attempting to carry multiple bags of any significant weight. The discomfort and/or pain caused by the weight of the bags only increases with the amount of time the bags must be carried. Thus, using a plastic bag to carry a heavy weight over a long period of time is not a viable option.

Additionally, while carrying heavy bags by hand may cause discomfort or pain to some individuals, other individuals simply do not have the strength to carry items by hand. For instance, many elder individuals have a decreased strength and cannot carry items that are a routine part of the life, such as shopping or grocery store bags. Further, some individuals cannot carry certain items because of a handicap or deformity. Nevertheless, such individuals in particular, need to be able to carry such items in order to remain independent from constant help. Thus, a portable device that is easily compacted for storage and that can be used to carry multiple items is desired.

SUMMARY OF INVENTION

The present invention is directed to a portable carrying device including a housing, an elongated flexible strap extendable from the housing, and one or more rigid support arms attached to the housing and configured for supporting an article to be carried. The portable carrying device can further include a coupler disposed on a first end of the elongated flexible strap and a mating structure disposed on a portion of the housing for releasably securing the coupler.

In one embodiment, a second end of the elongated flexible strap can be secured within the housing and the rigid support arm can be movably attached to the housing. The rigid support arm can be movable from a first position in which the rigid support arm is compactly stored relative to the housing, to a second position in which the rigid support arm is at least partially extended away from the housing. The rigid support arm can be pivotally mounted to the housing or can be slidably mounted to the housing. The housing can have one or more recesses for receiving the rigid support arm and the rigid support arm can have a shape corresponding to the recess. Additionally, one or more of the outer surfaces of the rigid support arm can be substantially continuous with a housing outer surface when the rigid support arm is disposed within the recess. Thus, the rigid support arm and the housing can form a combined outer surface that is substantially free of projections.

In one embodiment, a second end of the elongated flexible strap can be secured to a retractor disposed within the housing. Further, a multitude of securing devices can be disposed along a length of the elongated flexible strap. The securing devices can be rigid hook members or can include a flexible strap material where at least a portion of the strap material is attached to the elongated flexible strap with a hook and loop fastener. Additionally, the rigid support arm can be rotatably mounted to the housing about a first axis of rotation and can have one or more clamping members configured for clamping an article to the rigid support arm. The clamping member can be pivotable about a second axis having an orientation different from the first axis. The rigid support arm can be rotatably coupled to a ratchet mechanism and the clamping member can be pivotally coupled to a ratchet mechanism.

In one embodiment, the one or more rigid support arms can be removed from the housing. Additionally, the invention can include one or more rigid support arm securing members and a belt clip. The elongated flexible strap can include a cushioning member where the cushioning member can be configured for removably attaching to the rigid support arm. Additionally, an outer surface of at least a first one of the rigid support arms can form a continuous surface with at least a second one of the rigid support arms where the outer surface is substantially free of projections when the rigid support arms are in a compact position.

In another embodiment, a portable carrying device can include a housing, and an elongated flexible strap retractably extendable from within the housing, a coupler disposed on a first end of the elongated flexible strap, a mating structure disposed on a portion of the housing for releasably securing the coupler, and one or more rigid support arms movably attached to the housing and configured for supporting an article to be carried.

In still another embodiment, the portable carrying device can include a housing, an elongated flexible strap retractably extendable from within the housing, a coupler disposed on a first end of the elongated flexible strap, a mating structure disposed on a portion of the housing for releasably securing the coupler, and one or more rigid support arms movably attached to the housing and configured for supporting an article to be carried. The rigid support arm can be movable from a first position in which the rigid support arm is compactly stored relative to the housing, to a second position in which the rigid support arm is at least partially extended away from the housing for receiving an article to be carried.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE INVENTION

The present invention concerns a portable carrying device that can be used to carry multiple objects. In particular, the portable carrying device can be used for carrying multiple bags with handles. Advantageously, the portable carrying device can be used to carry multiple objects while leaving the user's hands free for other tasks. Additionally, the portable carrying device can transform to different configurations for use and for easy storage.

Figure 1A:
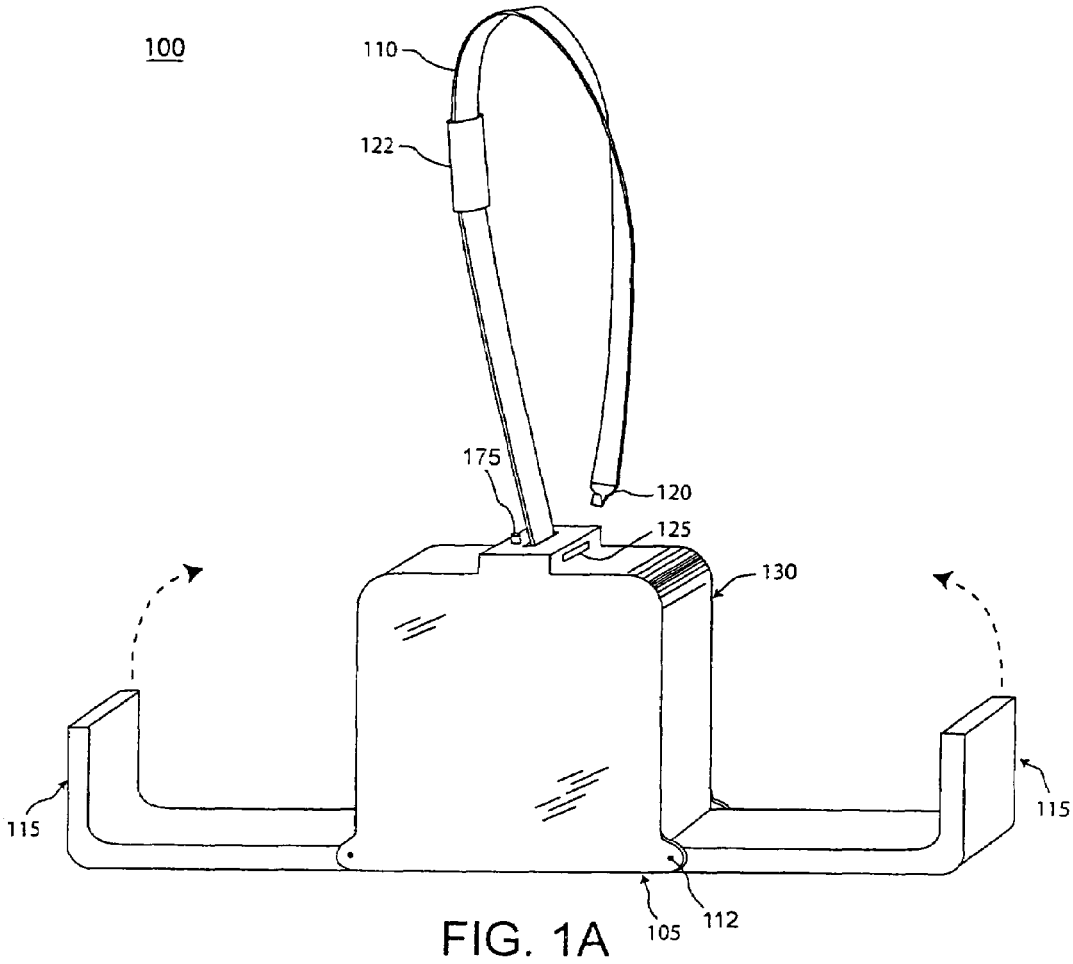
FIG. 1A is a perspective view of a first embodiment of a portable carrying device that is useful for understanding the inventive arrangements.
Figure 1B:
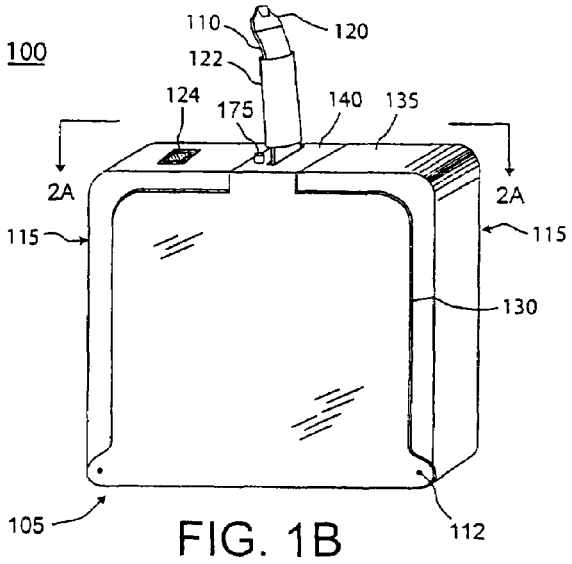
FIG. 1B is a perspective view of the portable carrying device in FIG. 1A in which the support arms are retracted.
Figure 1C:
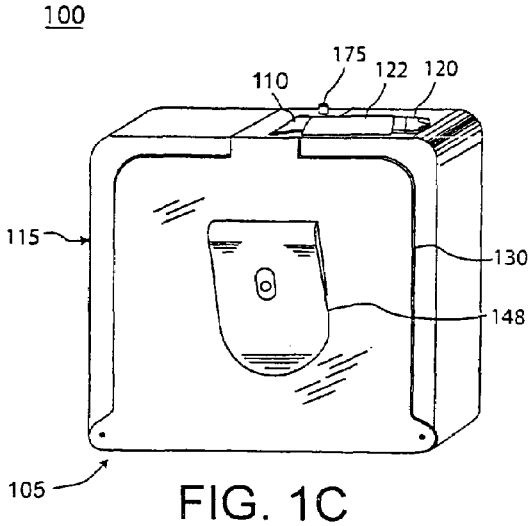
FIG. 1C is a perspective view of the portable carrying device in FIG. 1B showing another side of the portable carrying device.

Referring to FIGS. 1A, 1B, and 1C, one embodiment of the portable carrying device 100 is illustrated. The portable carrying device 100 includes a housing 105 and an elongated flexible strap 110 which is extendable from the housing 105. The strap 110 can include cushioning member 122 that is slidably movable along the length of the strap 110. The portable carrying device 100 also includes one or more rigid support arms 115 attached to the housing and configured for supporting an article to be carried. The housing 105 provides a base structure for connecting the portions of the portable carrying device 100. Although the housing 105 is shown in FIGS. 1A, 1B, and 1C as being substantially rectangular, one skilled in the art will recognize that the shape of the housing 105 is not limited. The shape can include other shapes, such as spherical, oval, and oblong and can even mimic the shape of a particular object, such as a cartoon character where the character's arms function as the rigid support arms 115. Additionally, the housing 105 and the rigid support arms 115 can be constructed of a hard plastic, metal, ceramic, or any other suitable material.

The strap 110 can be disposed within the housing 105 and can be adjusted in length to be customized for the size and shape of a particular user. For example, the strap 110 can be connected to a lockable retractor located with housing 105. The strap 110 can be constructed of any flexible material suitable for supporting objects such as a webbed material, neoprene, leather, and the like. The strap 110 includes a coupler 120 disposed on a first end of the strap 110 and a second end (not shown) secured within the housing 105. The coupler 120 can be used to releasably secure the first end of the strap 110 to a mating structure 125 disposed on a portion of the housing 105. The coupler 120 and mating structure 125 depicted in FIG. 1A are simply a hook and a recess for receiving the hook that can be constructed of a hard plastic, metal or ceramic. Nevertheless, FIG. 1A illustrates only one embodiment of a suitable combination for securing the strap 110 to the housing 105. One skilled in the art can recognize that a variety of a combinations of a coupler 120 and a mating structure 125 can be suitably used. A non-exhaustive list of a coupler 120 and mating structure 125 includes a hook and loop fastener, a clip and buckle, hook and swivel, and the like.

The rigid support arms 115 can be movably attached to the housing 105 to allow the portable carrying device 100 to be transformed to a variety of configurations. For example, the rigid support arms 115 can be pivotally mounted to the housing 105 as shown in FIGS. 1A, 1B, and 1C using any suitable pivot coupling 112, such as hinge or an axel, to allow for smooth transitions between the first position and the second position. Nevertheless, those skilled in the art will appreciate that other configurations are also possible and the invention is not limited in this regard.

FIG. 1B depicts the rigid support arms 115 in a first position in which the rigid support arms are compactly stored relative to the housing 105. Preferably, the housing 105 can have one or more recesses 130 for receiving the rigid support arms 115. In the embodiment shown in FIGS. 1A, 1B and 1C, the rigid support arms 115 can each have a shape corresponding to the shape of the recess 130, thereby allowing the rigid support arms 115 to be compactly stored relative to the housing 105 in a first position.

In one embodiment as shown in FIG. 1B, the outer surface 135 of the rigid support arm 115 can be substantially continuous with the housing outer surface 140 when the rigid support arm is disposed within recess 130. In this compacted first position, the rigid support arms 115 and the housing 105 form a combined outer surface that is substantially free of projections. A portable carrying device 100 in a compacted first position that has a combined outer surface substantially free of projections is advantageously configured for storage in a purse, glove box, pocket, or other convenient location. Still, other arrangements of the invention can include an outer surface that has one or more projections and such arrangements are also within the scope of the invention.

As illustrated in FIG. 1A, the rigid support arms 115 can be moved to a second position in which the rigid support arms 115 are at least partially extended away from the housing 105. In FIG. 1A, the rigid support arms 115 are extended approximately 90° from their compacted first position shown in FIG. 1B. Nevertheless, the invention is not limited in this regard. For example, the rigid support arms 115 and coupling 112 can be designed to pivot 30°, 45°, 60°, 75°, 90°, 105°, or any other suitable angle, without limitation. Moving the rigid support arms 115 from the first position of FIG. 1B to the second position of FIG. 1A transforms the portable carrying device 100 from a compact device 100 to portable carrying device 100 ready to support multiple objects.

Turning to FIG. 1C, the portable carrying device 100 can include an belt clip 148 for removably attaching the portable carrying device 100 to a belt or other similar structure. The invention is not limited to a belt clip 148 as any suitable structure, such as a carabiner, loop and hook fastener, and the like, can be used for removably attaching the portable carrying device to a belt, a strap, or other similar object. Additionally, it should be noted the belt clip 148 is not necessary for storing the portable carrying device 100 when not in use, as the portable carrying device 100 is preferably sized to fit in a purse, glove box, and even a pocket.

Additionally, FIG. 1C shows the cushioning member 122 secured to the rigid support arm 115. Preferably, the cushioning member 122 can be secured to the rigid support member 115 via hook and loop fasteners 124, shown on the rigid support arm 115 in FIG. 1B. Nevertheless, the invention is not limited in this regard and the cushioning member 122 can be secured to the rigid support arm 115 via any suitable structure and can also be secured to the housing 105. Securing the cushioning member 122 to the rigid support arm 115 can prevent a portion of the strap 110 from remaining free and catching on other objects and can also prevent the rigid support arm 115 from inadvertently extending. Furthermore, it should be noted that the invention is not limited to securing the strap 110 in this regard as the strap 110 can be retracted within the housing 105 so that the coupler 120 is flush with the surface of the housing 105.

Figure 2A:
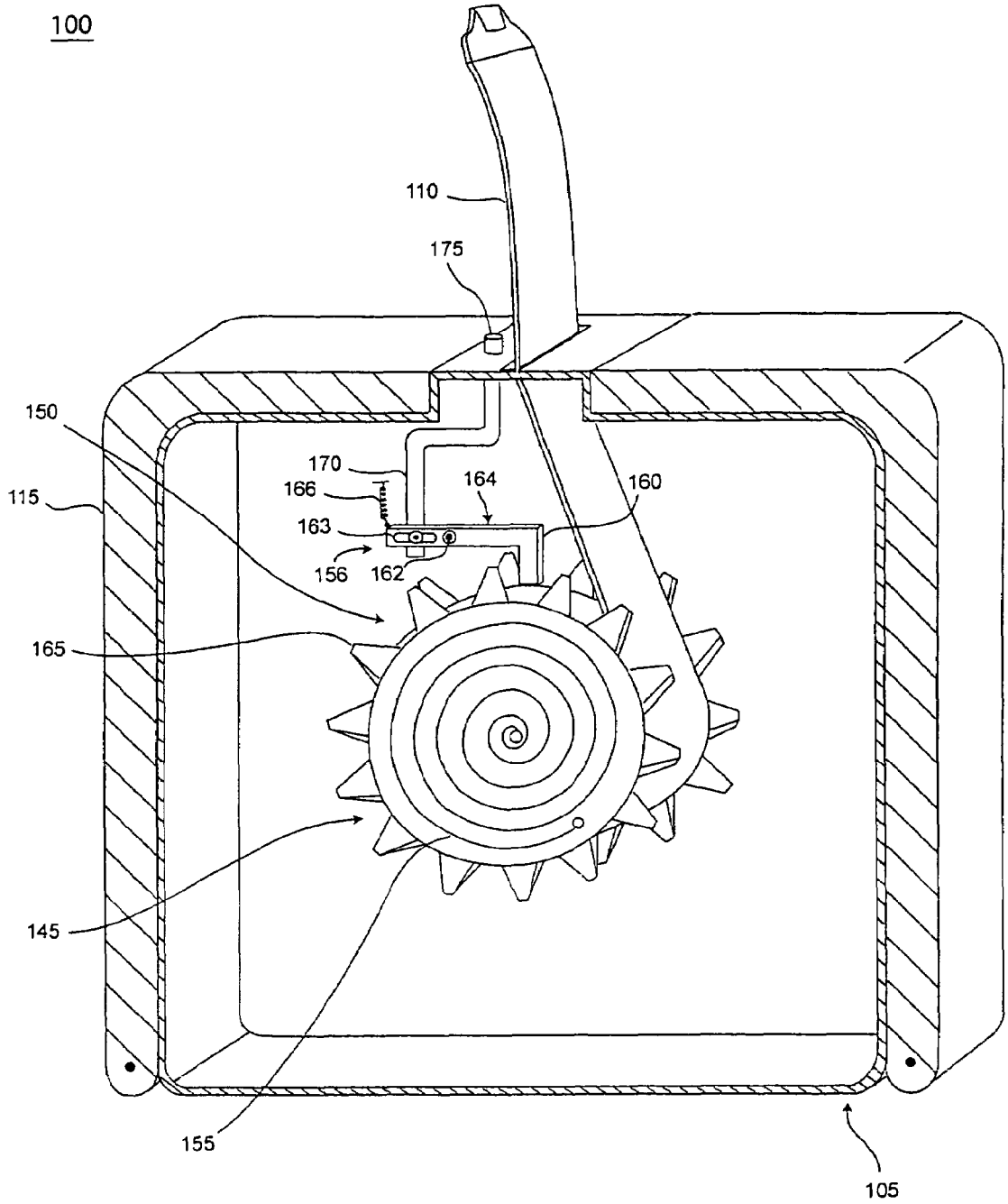
FIG. 2A is a cross-sectional view of the portable carrying device in FIG. 1B taken along lines 2-A, with a retractor shown in a locked configuration.
Figure 2B:
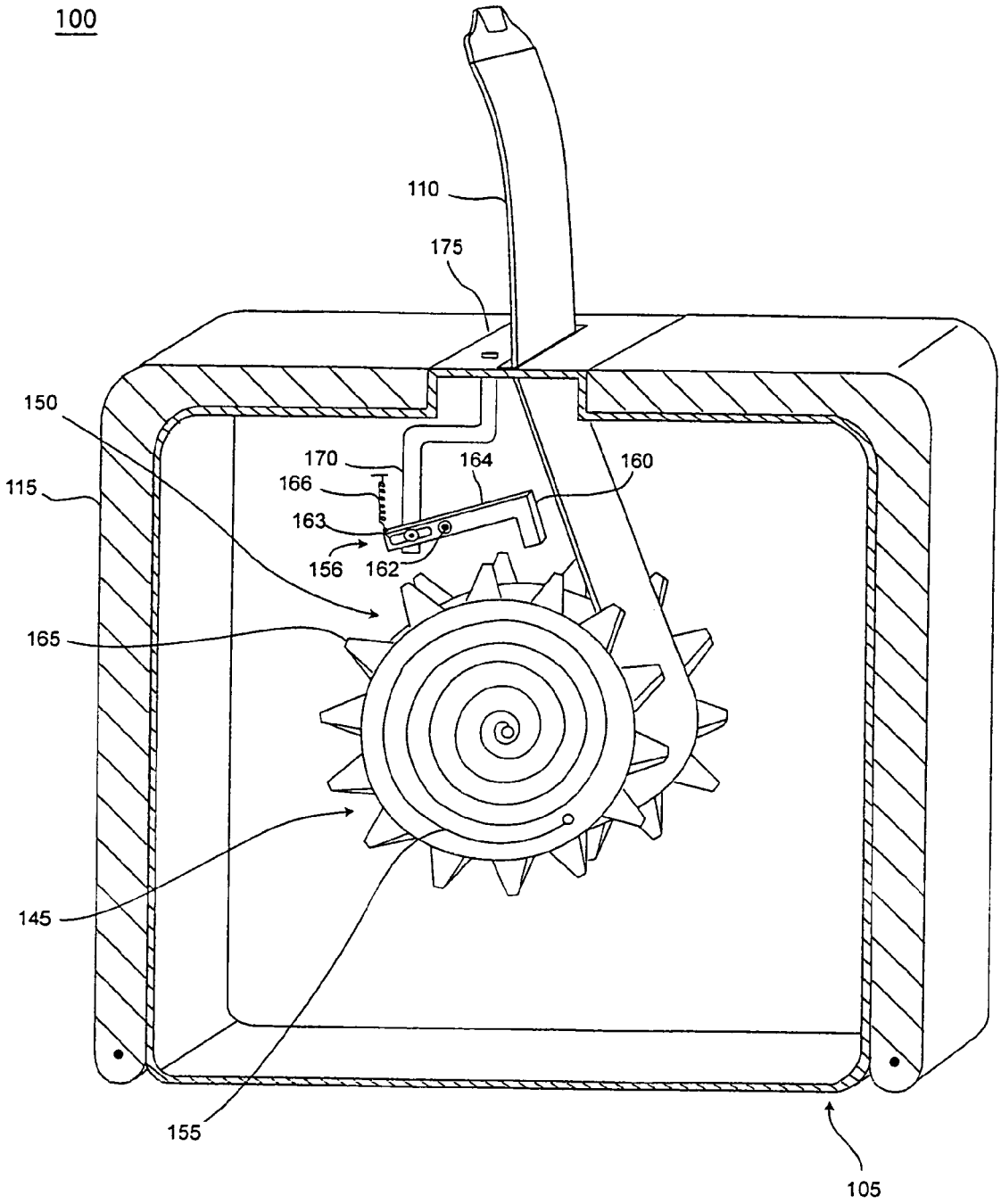
FIG. 2B is a cross-sectional view of the portable carrying device in FIG. 1B taken along lines 2-A, with a retractor shown in an unlocked configuration.

Referring now to FIGS. 2A and 2B, the portable carrying device 100 can also include a retractor 145 for regulating the length of the strap 110 that is outside of the housing 105. The retractor 145 can include teeth 165, rotating structure 150, biasing member 155, and a spool (not shown). Similar to housing 105 and the rigid support arms 115, the retractor and its components can be constructed of any suitable material, such as hard plastic, metal, ceramic, and the like.

While any suitable retractor 145 can be used, the retractor 145 illustrated in FIGS. 2A and 2B is arranged to have the strap 110 wrapped around and secured to the spool. The spool is mounted to at least one rotating structure 150 having a suitable biasing member 155, such as a spiral spring, that applies a torque to the rotating structure 150. The biasing member 155 can be arranged so that it produces a torque for rotating the spool to retrieve excess strap 110. When the rotating structure 150 is free to rotate, the torque from the biasing member 155 causes the spool to rotate in a direction that retrieves excess strap 110 by wrapping the strap 110 around the spool.

To prevent the spool from rotating, a locking system 156 can be included. The locking system 156 can include an actuator 175 for operation by a user, a rod 170, a lever 164 having a locking bar 160 and rotatably coupled to axel 162, and a biasing member 166. The connected linkage of components that form the locking system 156 is attached to the housing 105 by axel 162 and can be constructed of any suitable material such as a hard plastic, metal, or ceramic. Further, the actuator 175 can also be constructed of a hard rubber.

The rod 170 is movably coupled to the lever 164 via channel 163 disposed within the lever 164 and the locking bar 160 is rigidly fixed to one end of the lever 164. The biasing member 166 of the locking system 156 is biased to move the locking system 156 into a locked configuration as shown in FIG. 2A. Thus, the locking system 156 will be unlocked and allow movement of the retractor 145 only when activated by the user.

A user can unlock the retractor 145 by depressing the actuator 175, that will cause a chain of reactions to unlock the retractor 145. Depressing the actuator 175 will cause the rod 170 to move, forcing the lever 164 to rotate on axel 162. In turn, the locking bar will be moved to a position where the locking bar no longer engages the teeth 165 of retractor 145, as shown in FIG. 2B. When the user releases the actuator 175, the biasing member 166 will force the locking bar 160 into the locked position where the retractor 145 cannot move the rigidly affixed locking bar 160. With the locking bar 160 moved to the locked position, the biasing member 155 of the retractor 145 is prevented from causing the spool to retract the strap 110. Furthermore, with the locking bar 160 moved to the locked position, additional strap 110 is prevented from being released from the spool. Consequently, the locking bar 160 in the locked position maintains a constant length of strap 110 that is outside of the housing 105.

In order to change the length of the strap 110 that is outside the housing 105, i.e. to either retrieve excess strap 110 or release additional strap 110, a user can depress the actuator 175 to move the locking bar 160 from the locked position. With the locking bar 160 in the unlocked position, the rotating structure 150 can rotate in either direction. Torque produced by the retractor biasing member 155 can rotate the spool and wind up portions of strap 110 that have been pulled out of the housing 105. Alternatively, with the locking bar 160 in the unlocked position and the spool able to rotate, a user can retrieve additional strap 110 to lengthen the amount of strap 110 that is outside of the housing 105. Thus, the retractor 145 allows a user to adjust the length of the strap 110 by depressing the actuator 175 and manually pulling on the strap 110 or allowing excess strap 110 to be retrieved by the retractor 145.

Those skilled in the art will appreciate that the retractor 145 and locking system 156 shown in FIGS. 2A and 2B are intended as merely one possible example of a retractor mechanism with corresponding locking mechanism. Retractor mechanisms with locking mechanism are well known in the art and any suitable strap retractor system with a locking mechanism can be used. For example, instead of a spring biased retractor, a hand cranked retractor mechanism could be used. Similarly, the locking arrangement shown is merely one possible example of a locking mechanism that can be used with the invention. Other locking mechanisms are also acceptable. For example, a simple friction pad could also be engaged against rotating structure 150 to lock the strap 110 in place.

Figure 3A:
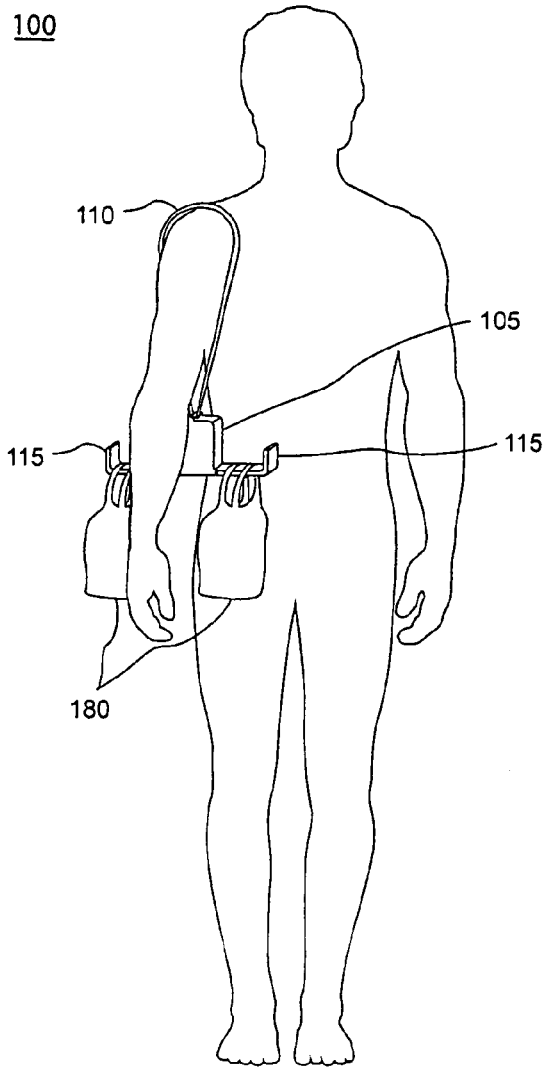
FIG. 3A is a drawing that is useful for understanding how the portable carrying device in FIG. 1A is used.

Turning to FIG. 3A, a portable carrying device 100 is shown in use. The portable carrying device 100 is illustrated with the strap 110 extended over and around the user's shoulder. Additionally, two bags 180 are shown supported by the rigid support arms 115. Thus, the entire weight of the portable carrying device 100 and the bags 180 is supported by the user's shoulder, allowing the user to comfortably carry the bags 180 while having the hands free to grasp other objects.

It should be noted that the invention is not limited to the particular arrangement as shown in FIG. 3A. For instance, excess strap, if needed, can be retrieved from the housing 105 to allow the user to place the strap 110 around the user's chest. Furthermore, the portable carrying device 100 is not limited in the number of bags 180 or other articles that can be supported by the rigid support arms 115.

Figure 3B:
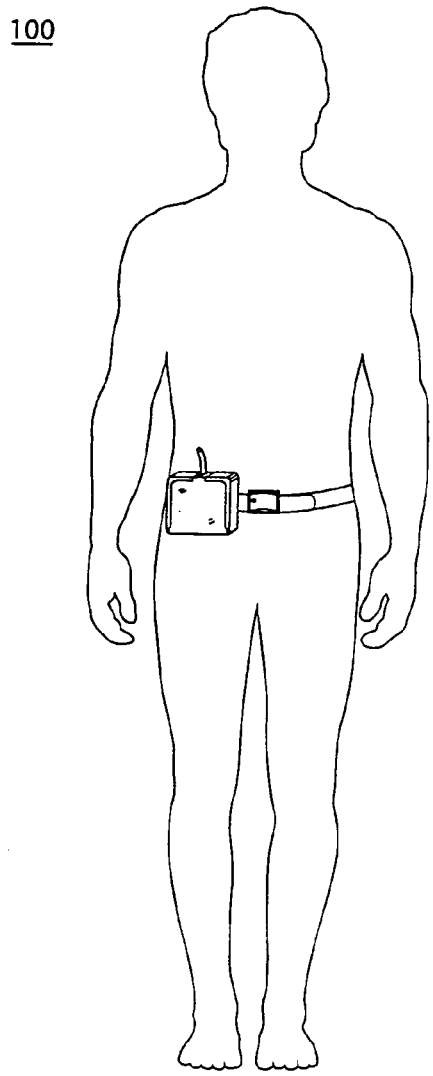
FIG. 3B is a drawing that is useful for understanding one option of storing the portable carrying device in FIG. 1A when not in use.

Further, in FIG. 3B the portable carrying device 100 is shown while not in use as being attached to the user's belt. The belt clip (shown in FIG. 1C) allows the portable carrying device 100 to be removably attached to the user's belt, and thus can be carried while not in use without inconvenience to the user. In such an arrangement, the portable carrying device 100 can be carried by the user on a daily basis for use whenever needed.

Figure 4A:
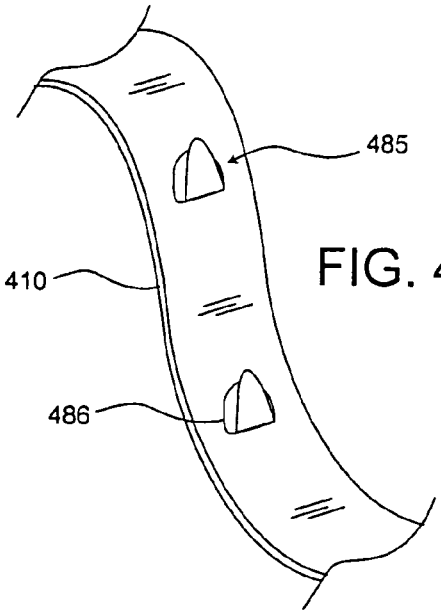
FIG. 4A is an enlarged perspective view of a strap that can be used with the portable carrying device in FIG. 1A.
Figure 4B:
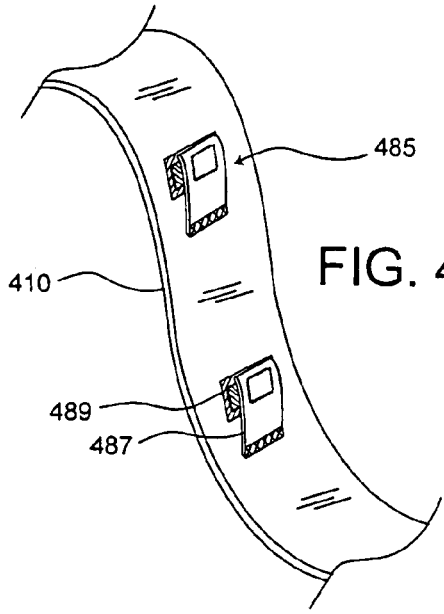
FIG. 4B is an enlarged perspective view showing an alternative embodiment of a strap that can be used with the portable carrying device in FIG. 1A.
Figure 4C:
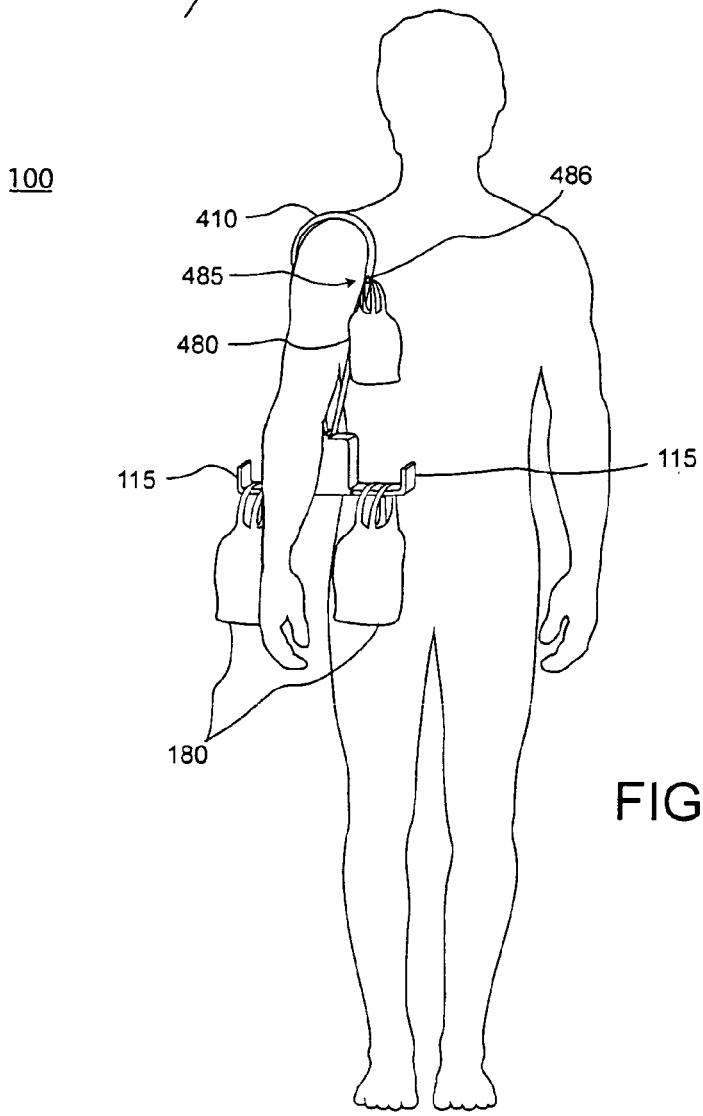
FIG. 4C is a drawing that is useful for understanding how the strap in FIG. 4A can be used in conjunction with the portable carrying device in FIG. 1A.

One embodiment of a strap 410 that can be used with portable carrying device 100 is illustrated in FIGS. 4A-4C. FIGS. 4A and 4B depict multiple securing devices 485 disposed along the length of the strap 410. In FIG. 4A, the multiple securing devices 485 are rigid hook members 486. The rigid hook members 486 can be constructed of any suitable material such as plastic, metal, ceramic and the like. The rigid hook members 486 can be used to support articles and are particularly well suited for supporting bag handles, such as plastic bag handles.

In FIG. 4B, the multiple securing devices 485 include a flexible material 487, of which one end is coupled, for example by stitching, to the strap 410. The opposite end of the flexible material 487 can be provided with a hook and loop fastener 489 that can allow the strap material 487 to be releasably coupled to the strap 410. Similar to the rigid hook members 486, the flexible material 487 can support articles such as bags with handles. Nevertheless, the flexible material 487 is particularly well suited for supporting other objects without handles that can be secured by the flexible material 487, such as pens, keys, and the like. Accordingly, the invention is not limited to a strap that includes securing devices.

FIG. 4C depicts a portable carrying device 100 with strap 410 that is supporting multiple bags 180. In addition to the bags 180 being supported by rigid support arms 115, a bag 180 is also being supported by a securing device 485. In this particular embodiment, the securing device 485 is a rigid hook member 486; nevertheless, the invention is not limited in this regard as a flexible material 487 with a hook and loop faster can also be used. Furthermore, the strap 410 can include multiple securing devices 485 located along the length of the strap 410. Additionally, the securing devices 485 located along the strap 410 can include a combination of hook members 486 and flexible material 487 with a hook and loop fastener 489.

Figure 5A:
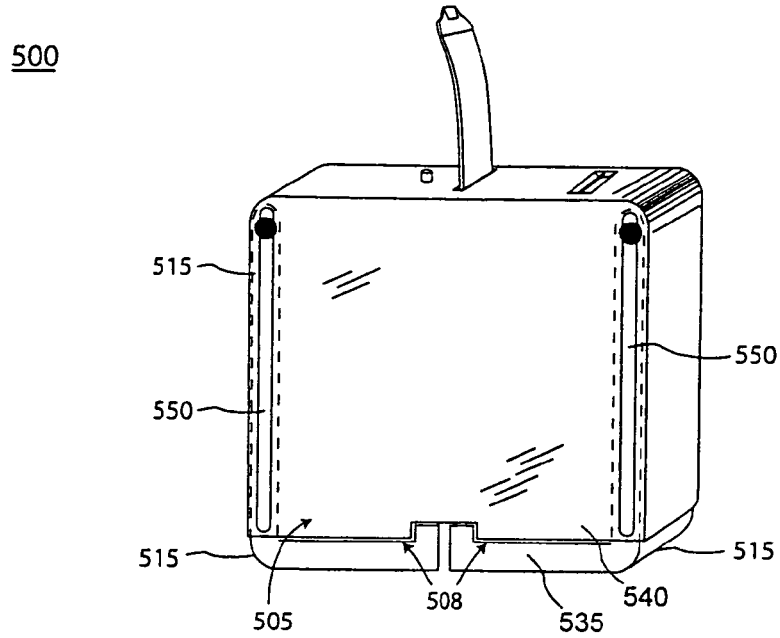
FIG. 5A is a perspective view of an alternative embodiment of a portable carrying device shown in a compact arrangement.
Figure 5B:
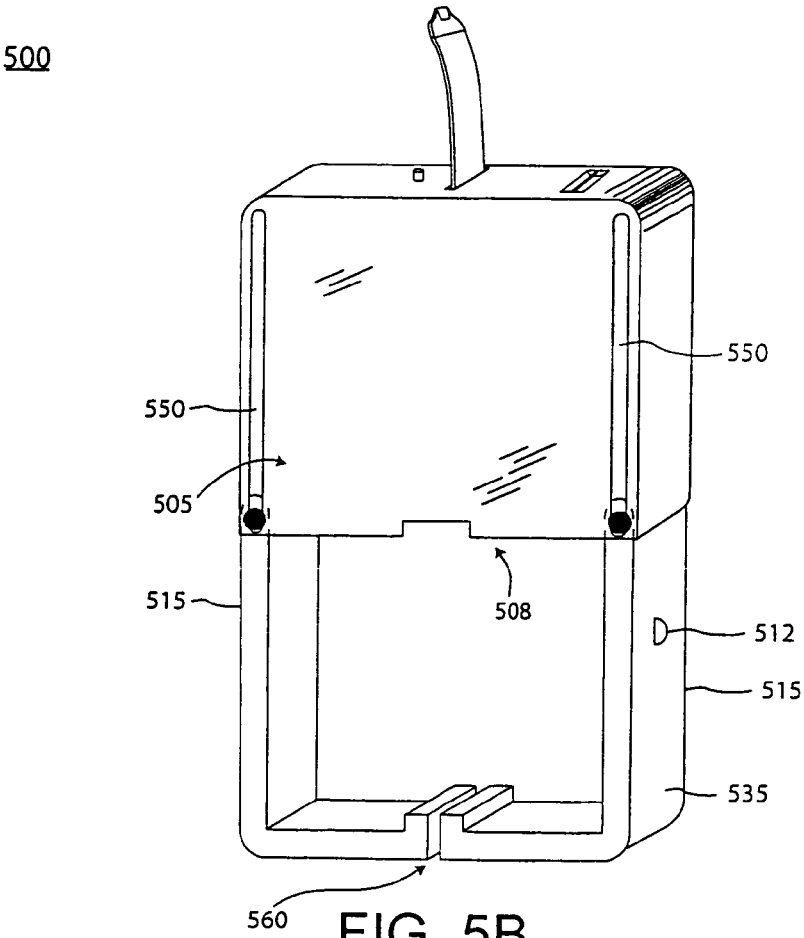
FIG. 5B is a perspective view of the portable carrying device of FIG. 5A shown in an extended arrangement.

An alternative embodiment of a portable carrying device is shown in FIGS. 5A and 5B. A portable carrying device 500 can have a housing 505 with one or more recesses 508 for receiving rigid support arms 515 that have a shape generally corresponding to the shape of the recess 508. Similar to other embodiments, the housing 505 and rigid support arms 515 can be constructed of a hard plastic, metal, ceramic, and the like.

In FIG. 5A, the rigid support arms 515 are in a compacted position and are firmly secured within the recess 508 of housing 505. The rigid support arms 515 can be secured in the compacted position with a rigid support arm securing member 512. In one arrangement as shown in FIG. 5B, the rigid support arm securing member 512 can include a detent ball 512 constructed of a metal, plastic, or ceramic and located on the rigid support arms 515. The detent ball 512 can be biased to extend outward from the rigid support arms 515, but can be depressed to not protrude beyond the outer surface 535 of the rigid support arms 515. In operation, with biased detent ball 512 depressed, the rigid support arms 515 can slide into the housing 505. At a location within the housing 105, the detent ball 512 can extend into a corresponding detent (not show) to secure the rigid support arms 515 in the compacted position. The rigid support arms 515 can be slid to the extended position by pulling on the rigid support arms 515 with sufficient force to overcome the bias of the detent ball 512.

Nevertheless, it should be noted that the rigid support arms 515 can be secured within the housing 505 and in a compacted position with other rigid support arm securing members as is known in the arts. In one example of such a locking arrangement (not shown), the rigid support arms 515 can be secured in a compacted position using locking structures located within the housing 505 and having controls on the outside of the housing 505. Notably, when the device 500 is in its compacted configuration, the housing outer surface 540 and the rigid support arm outer surface 535 can form a surface that is substantially free of projections.

The rigid support arms 515 can be slidably mounted within or on a portion of the housing 505. While FIGS. 5A and 5B show the rigid support arms 515 slidably mounted within channels 550, the invention is not limited in this regard as any suitable slidable mount, such as a tongue and a groove, can be used. The portable carrying device 500 can be transformed from a compacted configuration, as shown in FIG. 5A, to an extended configuration, as shown in FIG. 5B by sliding the rigid support arms 515 from a compacted position to an extended position.

In the extended position, articles can be hung or placed on the rigid support arms 515. For example, bag handles can be slid through gap 560 between the two rigid support arms 515 and draped around each respective rigid support arm 515. Additionally, although the rigid support arms 515 are slidably mounted within channels 550, the rigid support arms 515 can pivot slightly to increase size of the gap 560 and allow for larger objects to be draped around the rigid support arms 515. When the portable carrying device 500 is not in use, the rigid support arms 515 can be returned to the compacted position for storage.

Figure 6A:
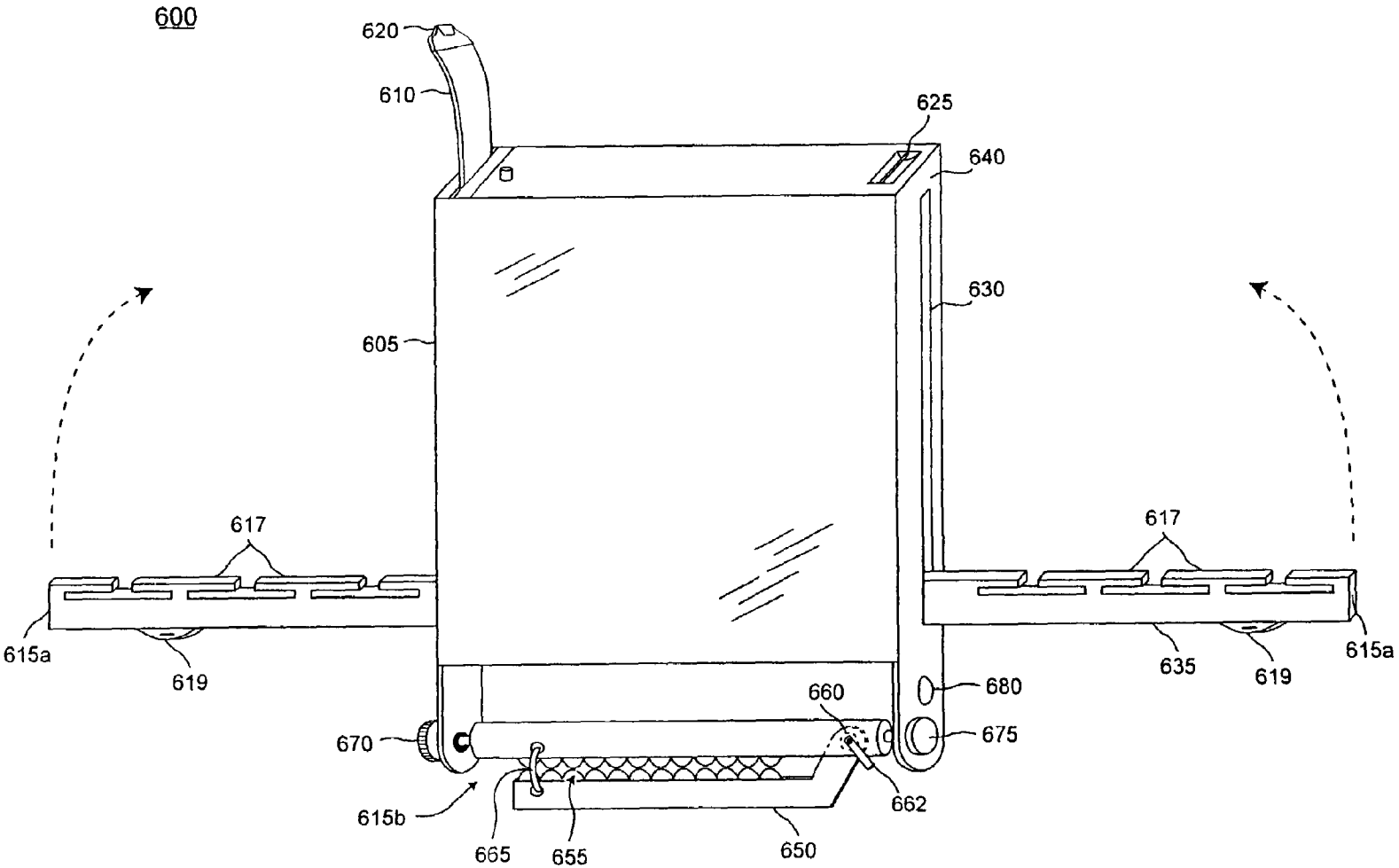
FIG. 6A is an alternative embodiment of a portable carrying device in accordance with the inventive arrangements.

Another embodiment of a portable carrying device is illustrated in FIG. 6A. The portable carrying device 600 includes a strap 610, a coupler 620 and corresponding mating structure 625 located on housing 605. The portable carrying device 600 also includes rigid support arms 615*a* for supporting one or more objects. Notably, the rigid support arms 615*a* include notched structures 617 that can be used to separate the handles of bags to be carried. Such notched structures 617 allow the supported articles to be strategically placed on the support arms 615*a* to achieve a balanced load. Similar to the other embodiments of a portable carrying device, the components of portable carrying device 600 can be constructed of any suitable materials as discussed previously.

The rigid support arms 615*a* can be movably coupled on the interior of the housing 605 via a coupling, such as an axel, hinge, pivot, and the like. The rigid support arms 615*a* can be moved into recess 630 to allow the rigid support arms 615*a* to be moved to a compact position, as shown by the dotted arrows. The rigid support arms 615*a* can be disposed in recess 630 as the rigid support arm 615*a* has a corresponding shape to recess 630. When the rigid support arm 615*a* is disposed in recess 630, the outer surface 635 of the rigid support arm 615*a* can be substantially continuous with the housing 605 outer surface 640. In such a configuration, the rigid support arm 615*a* and the housing 605 form a combined outer surface that is substantially free of projections. Additionally, the rigid support arms 615*a* can include a tab 619 for gripping when the rigid support arms 615*a* are disposed within the recess 630.

FIG. 6A also illustrates another rigid support arm 615*b* that is rotatably mounted to the housing 605 about a first axis of rotation and can be constructed of a hard plastic, metal, ceramic, and the like. The rigid support arm 615*b* includes at least one clamping member 650 configured for clamping an article to the rigid support arm 615*b*. The clamping member 650 can be pivotally coupled to the rigid support arm 615*b* about a second axis of rotation having a different orientation from the first axis rotation, as shown. Additionally, the clamping member 650 can be coupled to the rigid support arm 615*b* with a ratchet mechanism 660 having a release 662. As is known in the arts, a ratchet mechanism can allow rotation in one direction while preventing rotation in the opposite direction. In operation, the ratchet mechanism's release 662 can be moved to allow the clamping member 650 to be opened to allow bag handles to be draped over the clamping member 650. The release 662 can be moved again to pivot the clamping member 650 to a clamped position, as shown in FIG. 6A. In this position, the ratchet mechanism 660 can prevent the clamping member 650 from opening, even when heavy objects are hung from the clamping member 650.

It should be noted that the invention is not limited to having a ratchet mechanism 660 for controlling the pivoting of the clamping member 650. For instance, a spiral spring (not shown) can be located on the axis of coupling the clamping member 650 to the rigid support arm 615*b* and can produce a torque in the direction of pivoting the clamping member 650 to a clamped position. The tension provided by the spiral spring is preferably sufficient to pivot the clamping member 650 to a clamped position while still allowing a user to pivot the clamping member 650 to an open position for the introduction of articles to carry. Still, the spiral spring and the ratchet mechanism 660 are not essential and the invention is not limited in this regard.

The rigid support arm 615*b* can also include ridges 655 for separating articles to be carried and a locking member 665 for locking the clamping member 650 to the rigid support arm 615*b*. The ridges 655 can be formed of the same material as the support arm 615*b* or can be formed as a hard rubber for improved gripping. In operation, a user can place an article, preferably the handle of an article, on the clamping member 650 and pivot the clamping member 650 to the clamped position. The user can then rotate the rigid support arm 615*b* by applying a torque to the handle 670 in the direction of desired rotation. Rotating the rigid support arm 615*b* will cause the article to become progressively wrapped around the rigid support arm 615*b* to ensure a secure arrangement for carrying. An advantage of this feature is that a user is not required to manipulate loop handles of cloth or plastic bags. Instead, a user can simply drape the top of the bag on the clamping member and rotate the rigid support arm 615*b* until the bag is secured.

Additionally, a ratchet mechanism 675 can be included in housing 605 at the junction of rotatably coupling the rigid support arm 615*b* to the housing 605. As is known in the arts, the ratchet mechanism 675 can allow rotation of the rigid support arm 615*b* in one direction and prevent rotation in the opposite direction. Thus, once an article has been progressively wrapped around the rigid support arm 615*b*, the ratchet mechanism 675 can prevent unintentional unwrapping of the article. The ratchet mechanism 675 not only cooperates with the rigid support arm 615*b* to provide a stable structure for carrying an article, the ratchet mechanism 675 also provides a security feature that prevents an article from being unknowingly removed from the rigid support arm 615*b*. The ratchet mechanism 675 can be operated by a control device, such as button 680, that can be depressed to change the direction of ratcheted rotation of the rigid support arm 615*b*.

Figure 6B:
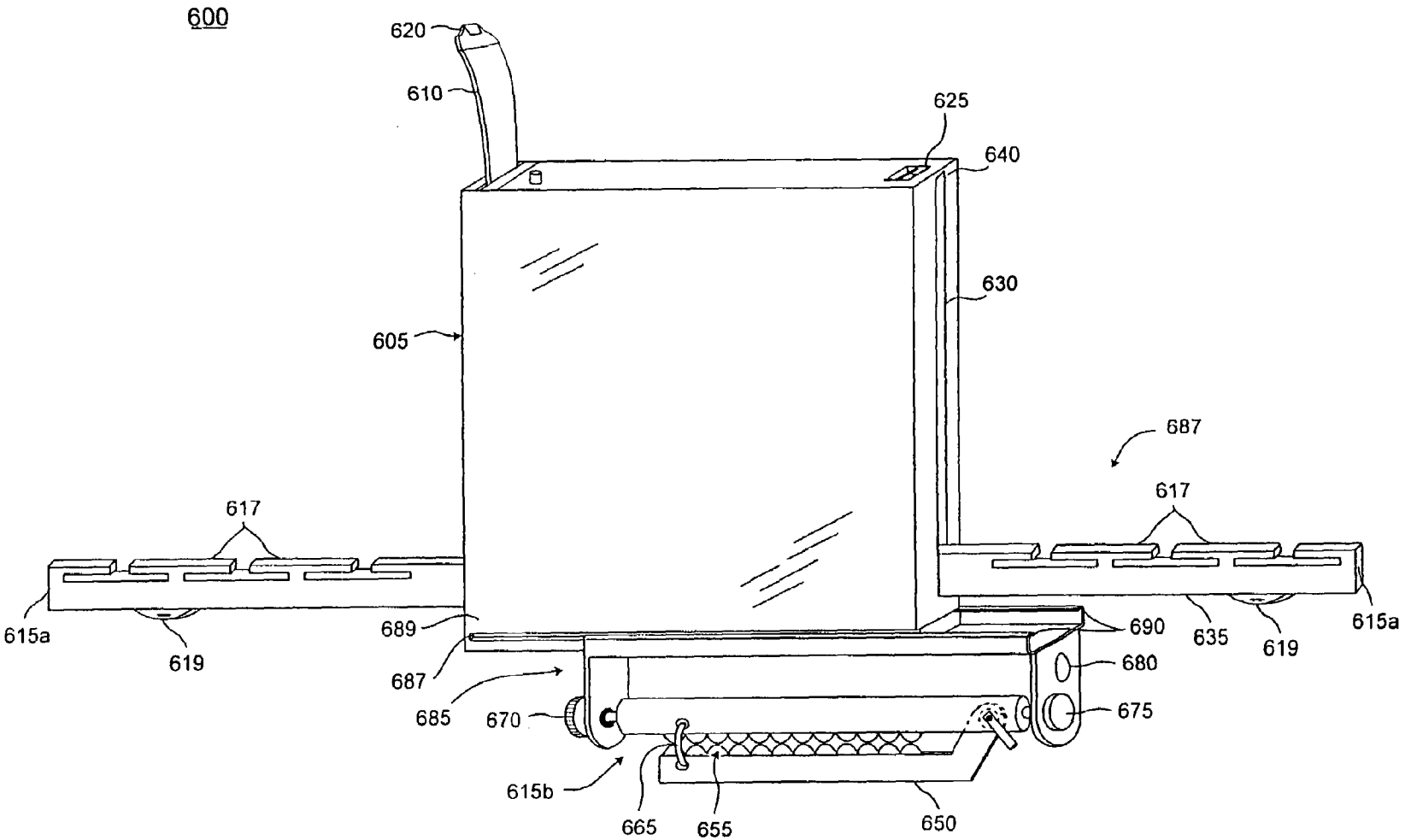
FIG. 6B is an alternative embodiment of the portable carrying device shown in FIG. 6A.

FIG. 6B shows another embodiment of the portable carrying device 600. In this embodiment, the rigid support arm 615*b* can be coupled to a removable mounting structure 685 that can allow the rigid support arm 615*b* to be removed from housing 605. Any suitable coupling arrangement can be used for this purpose. For example, one or more grooves 687 can be disposed within one or more faces 689 of the housing 605 for accepting one or more rails 690 of the removable mounting structure 685. Preferably, the housing 605 can have two grooves 687 disposed in opposing faces of the housing 605 and the removable mounting structure 685 can have two rails 690 for sliding along the grooves 687.

To ensure that the removable mounting structure 685 is secured to the housing 605 and cannot be inadvertently removed from the housing 605, the length of the grooves 687 and the corresponding rails 690 can be slightly shorter than the length of the housing face 689. In such an arrangement, the removable mounting structure 685 can be removed from the grooves 687 by sliding the removable mounting structure 685 out of the grooves 687.

The removable mounting structure 685 can be constructed of a hard plastic, rubber, and/or metal that can allow for slight bending without deformation. Additionally, its should be noted that the removable mounting structure 685 can be mounted to the housing 605 in a variety of other arrangements that are known in the art. For example, the removable mounting structure 685 can be mounted to the housing 605 with bolt and nut fasteners, clips, and other suitable structures that provide for a removable mounting.

Figure 7A:
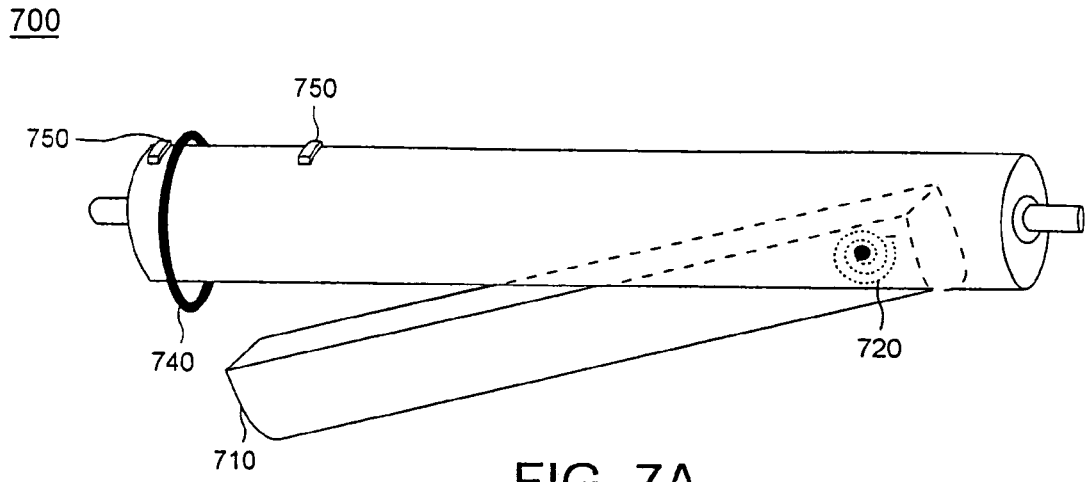
FIG. 7A is an enlarged perspective view showing an alternative embodiment of a rigid support member in accordance with the inventive arrangements.
Figure 7B:
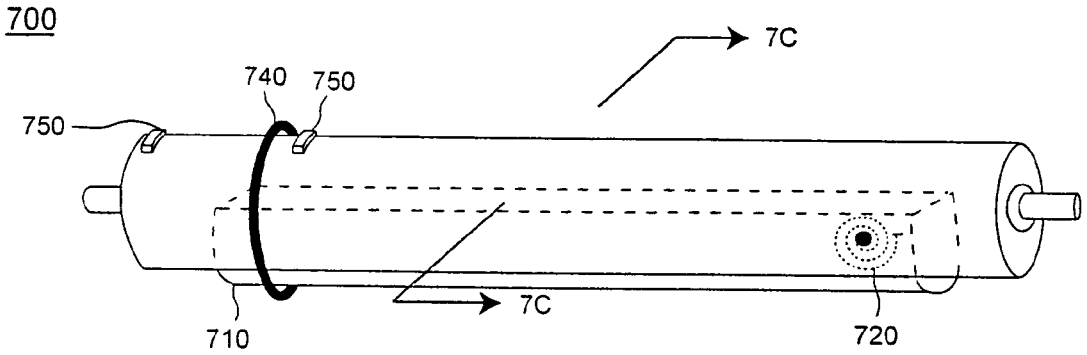
FIG. 7B is an enlarged perspective view that shows the rigid support member of FIG. 7A with a clamping member in a clamped position.
Figure 7C:
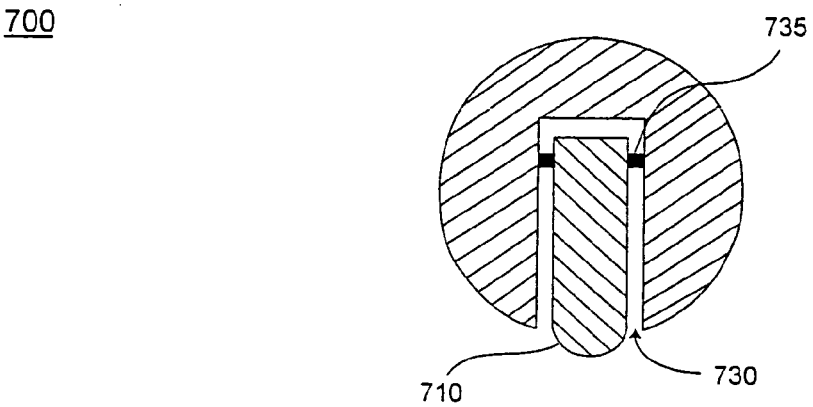
FIG. 7C is a cross-sectional view of the rigid support member in FIG. 7B taken along line 7C-7C.

In another embodiment, rigid support arm 700 is shown in FIGS. 7A-7C. The rigid support arm 700 is shown separate from a housing, but those skilled in the art will readily understand the rigid support arm 700 can be rotatably mounted to a suitable portable carrying device in a manner similar to the mounting of rigid support arm 615*b*, as shown in FIG. 6A. As also similar to the rigid support arm 615*b*, the rigid support arm 700 can be formed of a suitable hard plastic, metal, ceramic, and the like.

The rigid support arm 700 can include a clamping member 710 that is pivotally coupled to the rigid support arm 700 and a spiral spring 720 mounted at the point of coupling. The spiral spring 720 can produce a torque in the direction of pivoting the clamping member 710 to a clamped position, as shown in FIG. 7B. The clamping member 710 can also be pivoted to an open position as shown in FIG. 7A.

Turning to FIG. 7C, a cross-section taken along lines 7C-7C of the rigid support arm 700 is shown. This perspective shows that a substantial portion of the clamping member 710 is disposed within an elongated cavity 730 of the rigid support arm 700 when in clamped position. Nevertheless, this perspective also illustrates that there is unoccupied space for a bag handle to be clamped therein. Additionally, an axel 735 is shown as the movable coupling; however, the invention is not limited in this regard as any suitable movable coupling, such as a ratcheted coupling, can be used.

As an additional form of security, a ring member 740 can be included with the rigid support arm 700. The ring member 740 can slide along a portion of the rigid support arm 700 and is prevented from being removed from the rigid support arm 700 by raised structures 750. The ring member 740 can be positioned to allow the clamping member 710 to pivot to an open position as shown in FIG. 7A. As shown in FIG. 7B, the ring member 740 can be positioned to lock the clamping member 710 in clamped position and prevent unintentional opening of the clamping member 710. Additionally, the ring member 740 can be formed of any suitable material, such as a hard plastic, metal, ceramic, rubber, and the like.

Figure 8A:
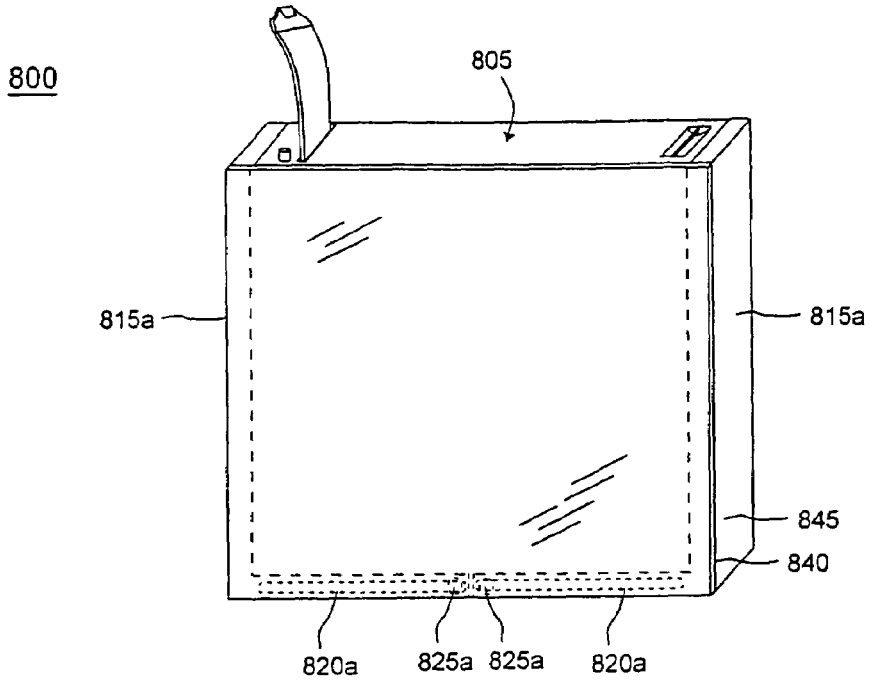
FIG. 8A is an alternative embodiment of a portable carrying device shown in a compact arrangement.
Figure 8B:
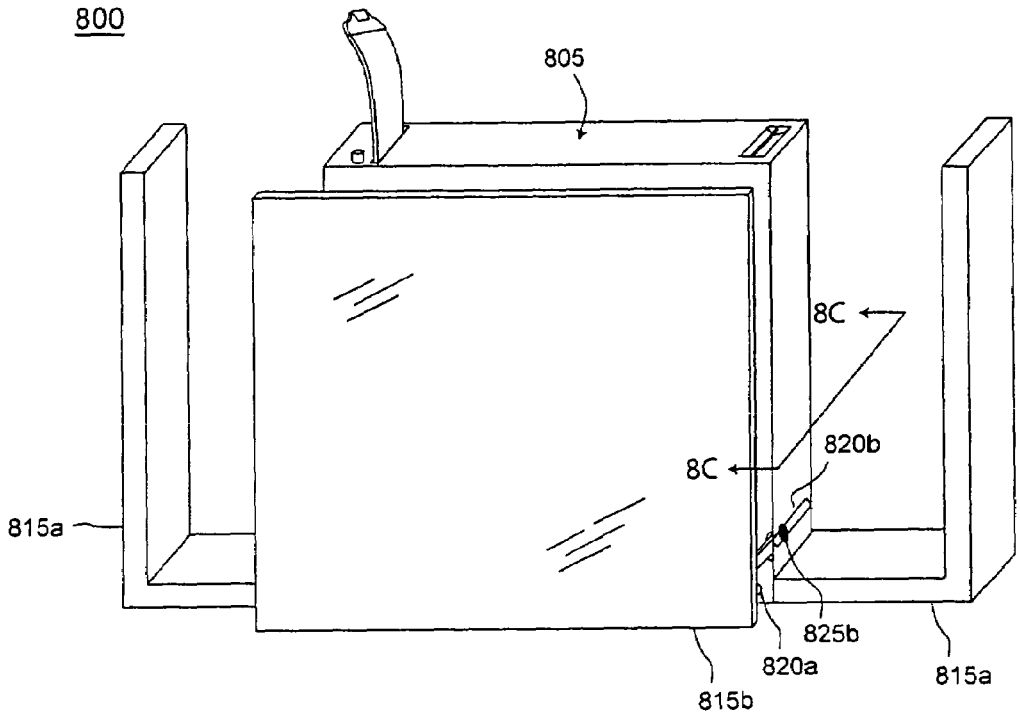
FIG. 8B is a perspective view of the embodiment of FIG. 8A shown in an extended arrangement.

Another embodiment of the portable carrying device is shown in FIG. 8A and FIG. 8B. Similar to the other embodiments discussed above, the portable carrying device 800 can include a strap coupled to a retractor. In another similarity to the other embodiments of the portable carrying device, the housing 805 and the rigid support arms 815*a* and 815*b* can be constructed of a hard plastic, metal, ceramic, and the like. The portable carrying device 800 is shown in FIG. 8A in a compacted configuration and shown in FIG. 8B in an extended configuration.

In FIG. 8A, dotted lines are used to illustrate channels 820 in which rigid support arms 815*a* are slidably mounted. The rigid support arms 815*a* are secured to the channels 820*a* via an end member 825*a* that has dimensions slightly larger than the dimensions of the channel 820*a* so that the rigid support arms 815*a* cannot be inadvertently removed from the channel 820*a*. In FIG. 8B, the rigid support arms 815*a* have been slid along channels 820*a* to an extended position that is suitable for carrying multiple objects. Rigid support arm 815*b* is also shown in an extended position. Similar to the channels 820*a* in which rigid support arms 815*a* are slidably mounted, rigid support arm 815*b* can also be slidably mounted in channels 820*b* and secured with end member 825*b*.

Figure 8C:
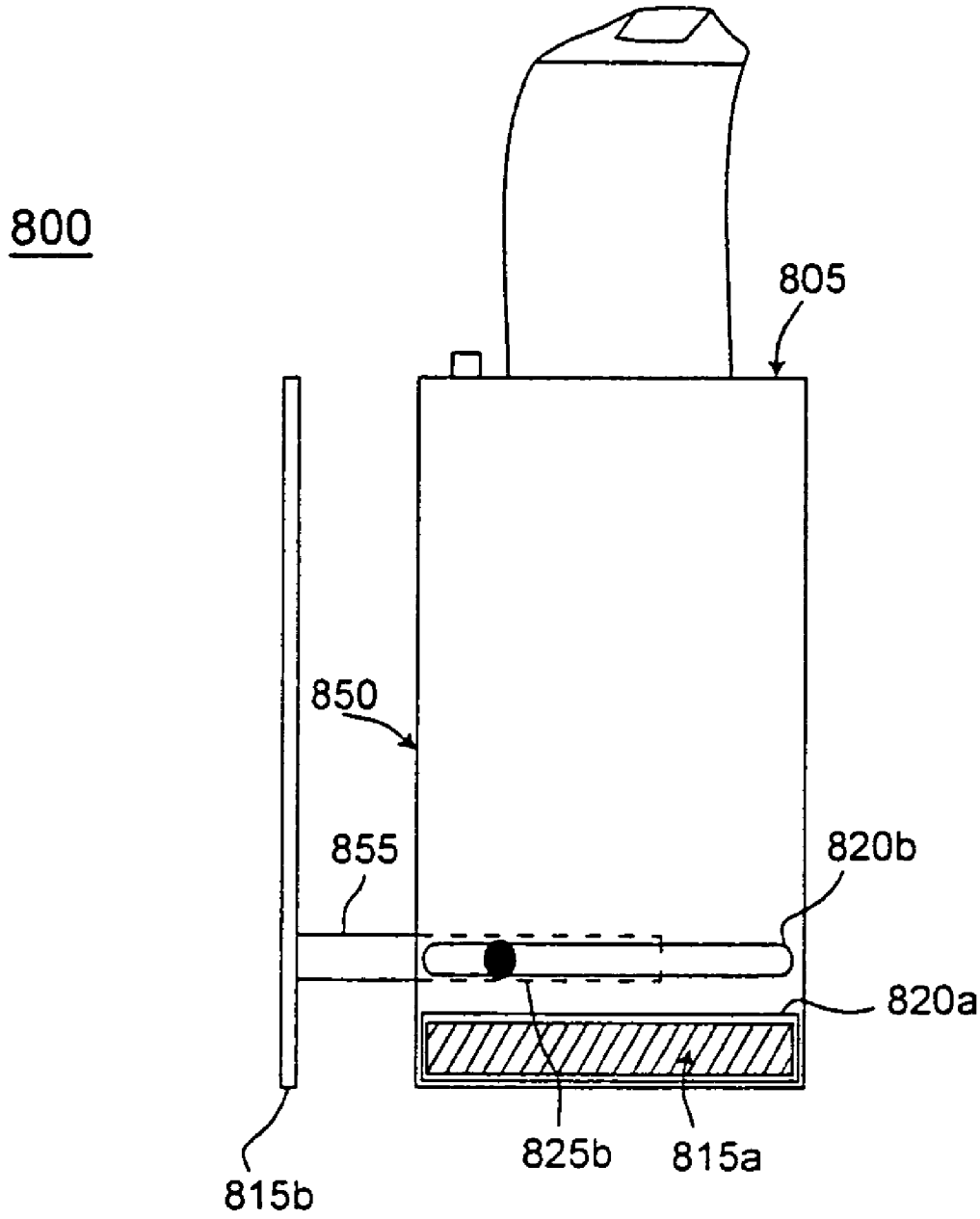
FIG. 8C is a side view of the embodiment of FIG. 8B from the perspective of line 8C-8C.

FIG. 8C shows a side view of FIG. 8B taken from a perspective of line 8C-8C and illustrates a portion of rigid support arm 815*a* in cross-section and rigid support arm 815*b* in an extended position. Rigid support arm 815*b* is shown with extension member 855 slidably mounted in channel 820*b* and partially extended from housing 805. The remaining portion of extension member 855 is shown with dotted lines to indicate its position along channel 820*b* within the housing 805. The channel 820*b* is shown above channel 820*a*; however, the invention is not limited in this regard as the placement of the channel 820*a* and 820*b* can be alternated without changing the operation of the portable carrying device 800. Further it should be noted that the dimensions of rigid support arm 815*b* correspond to the dimensions of surface 850 of housing 805 so that the rigid support arm 815*b* and housing 805 for a continuous surface that is substantially free of projections in the compact configuration.

The rigid support arms 815*a* and 815*b* can be used independently of each other and in different combinations. For example, a user can carry multiple objects with only rigid support arm 815*b*. Alternatively, a user may desire to carry multiple objects utilizing all the rigid support arms simultaneously. Thus, the use of portable carrying device 800 is not limited to any particular arrangement. Furthermore, it should be noted that the number of rigid support arms 815*a* and 815*b* is not limited as the invention is considered to cover multiple arrangements. For example, a rigid support arm can be included on the opposite side of the housing 805 from rigid support arm 815*b*. Additionally, rigid support arms 815*a* and 815*b* can also include multiple rigid support arms along side of the housing 805 instead of the single rigid support arms shown.

Returning to FIG. 8A, the portable carrying device 800 is shown in a compacted configuration where the rigid support arms 815*a* and 815*b* meet to form an outer continuous surface that is substantially free of projections. FIG. 8A illustrates that the rigid support arm 815*b* is slightly wider than the width of the housing 805 so that the edge 840 of rigid support arm 815*b* is inline with the surface 845 of rigid support arm 815*a* to form the continuous surface that is substantially free of projections. Nevertheless, the invention is not limited in this regard as the rigid support arm 815*b* can be the same shape and dimensions as the shape and dimensions of the housing 805. Thus, the rigid support arm can provide a face of the housing 805 that can be extended to be used as rigid support arm 815*b*.

Figure 9B:
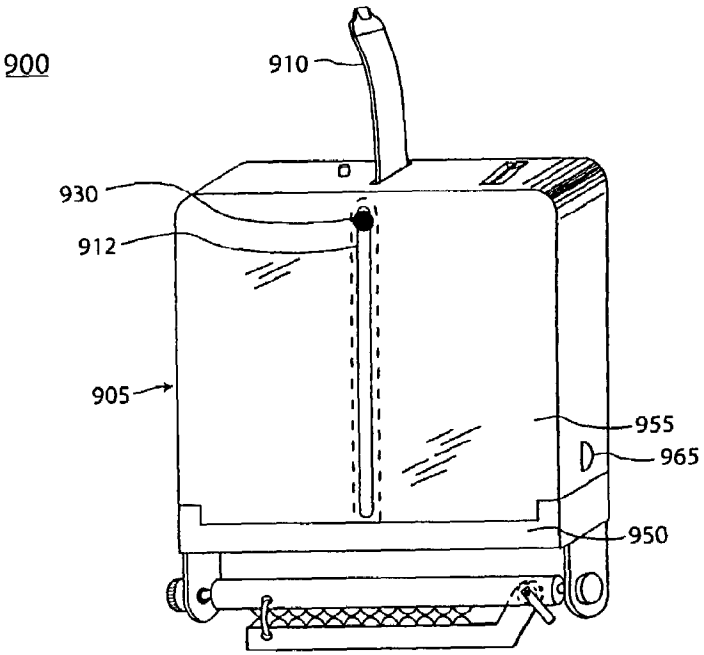
FIG. 9B is a perspective view of the embodiment of FIG. 9A shown in a compact arrangement.
Figure 9A:
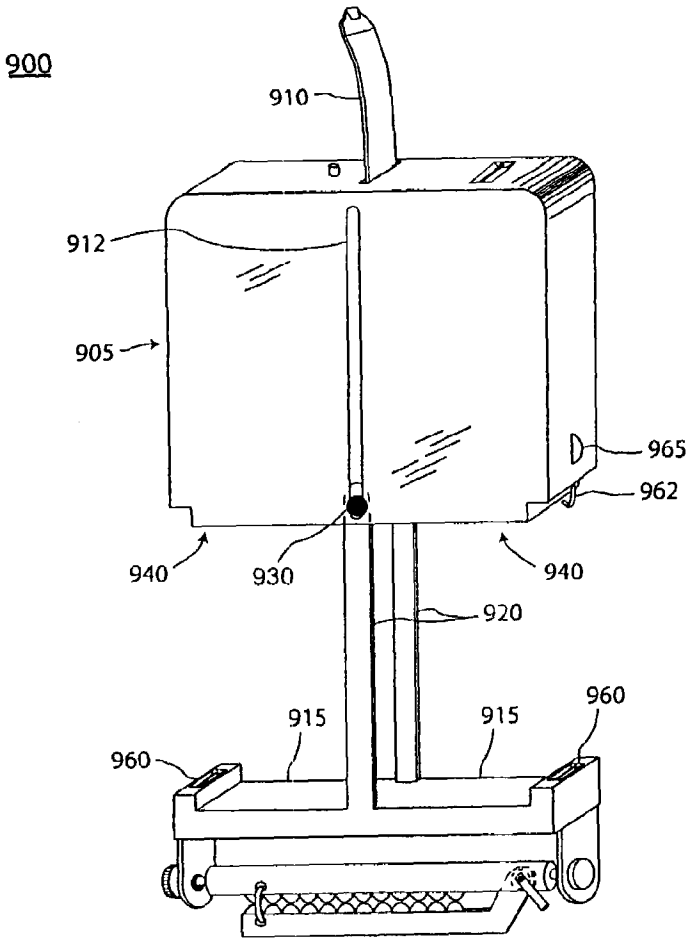
FIG. 9A is a perspective view of an alternative embodiment of a portable carrying device shown in an extended arrangement.

Another embodiment of the portable carrying device 900 is shown in FIG. 9A and FIG. 9B. FIG. 9A illustrates the portable carrying device 900 with rigid support arms 915 in an extended position that can be used for carrying objects; FIG. 9B illustrates the portable carrying device 900 with rigid support arms 915 in a compacted position that can be advantageous for storing the portable carrying device 900.

Portable carrying device 900 can include one or more channels 912 for slidably mounting extension members 920 to the housing 905. The extension members 920 can be secured to the channels 912 via an end member 930 that has dimensions slightly larger than the dimensions of the channel 912 so that the extension members 920 cannot be inadvertently removed from the channel 912. The end member 930 can be configured to be removed to allow the extension members 920 and the rigid support arms 915 to be removed from the housing 905 for maintenance and other purposes. Additionally, the end member 930 can include a rough outer surface, such as multiple ridges, that can be used for gripping by a user.

The portable carrying device 900 can also include a retractor (not shown) for regulating the length of the strap 910. One skilled in the art will readily understand that, in this arrangement, the retractor can be located slightly to one side of channels 912 so as to not interfere with the operation of the channels 912 or the operation of the retractor. Furthermore, one skilled in the art would readily understand that the channels 912 can be displaced from a central area of the housing 905 without materially altering the operation of the portable carrying device 900. Thus, the invention is not limited with regard to the placement of the retractor or the placement of the channels 912.

In this arrangement, the housing 905 can have one or more recesses 940 for receiving the rigid support arms 915. The rigid support arms 915 can have a shape that corresponds to the shape of the recess 940. Thus, when the rigid support arms 915 are in the compacted configuration, the outer surface 950 of the rigid support arms 915 can be substantially continuous with the housing outer surface 955 to form a combined outer surface that is substantially free of projections.

Furthermore, the rigid support arms 915 can be secured to the housing 905 by internal rigid support arm securing members 962 that hook to one or more lock structures 960. The internal rigid support arm securing members 962 can be operated by depressing one or more buttons 965 and causing the rigid support arm securing members 962 to pivot, thereby releasing the lock structures 960. When released, the rigid support arms 915 can be moved from the compacted configuration of FIG. 9B to the extended configuration of 9A. Additionally, the internal rigid support arm securing members 962 can be biased to a pivot to a hook position, thereby hooking the lock structures 960 when the rigid support arms 915 are slid to the compacted configuration. It should be noted that the invention is not limited in this regard as the rigid support arms can be secured the housing 905 in a variety of other arrangements that are known in the art.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A portable carrying device, comprising:

a housing sized to fit in a pocket;

an elongated flexible strap retractably extendable from an upper portion of said housing and having two opposing ends;

at least two rigid support arms configured to be movably extendable to rigidly project from a lower portion of said housing opposed from said upper portion when in a first position, and returned to a second position in which said rigid support arms are not extended from said housing, at least a portion of each of said at least two rigid support arms having a curved section extending generally toward said upper portion of said housing when said rigid support arms are in said first position;

a coupler disposed on a first one of said two opposing ends of said elongated flexible strap;

a retractor disposed within said housing and secured to a second one of said two opposing ends of said elongated flexible strap; and a mating structure disposed on said upper portion of said housing configured for releasably securing said coupler to said housing;

wherein one or more bags can be removably carried on said two rigid support arms when in said first position, and said flexible strap is extended around a user's shoulder.

2. The portable carrying device according to claim 1, wherein said curved section of said at least two rigid support arms defines a contour which conforms to an exterior surface of said housing.

3. The portable carrying device according to claim 1, wherein said at least two rigid support arms are pivotally mounted to said lower portion of said housing.

4. The portable carrying device according to claim 1, wherein said housing has at least two recesses configured for respectively receiving said at least two rigid support arms.

5. The portable carrying device according to claim 4, wherein said curved section of said at least two rigid support arms have a shape corresponding to said at least two recesses.

6. The portable carrying device according to claim 5, wherein at least one outer surface of said rigid support arm is substantially continuous with a housing outer surface when said rigid support arm is disposed within said recess, whereby said rigid support arm and said housing form a combined outer surface that is substantially free of projections.

7. The portable carrying device according to claim 1, wherein said elongated flexible strap includes a cushioning member.

8. The portable carrying device according to claim 1, further comprising a belt clip.

9. A portable carrying device, comprising:

a housing;

an elongated flexible strap retractably extendable from said housing and having two opposing ends;

at least two rigid support arms attached to said housing, each of said rigid support arms configured for supporting an article to be carried thereon;

a coupler disposed on a first one of said two opposing ends of said elongated flexible strap;

a retractor disposed within said housing and secured to a second one of said two opposing ends of said elongated flexible strap; and a mating structure disposed on a portion of said housing configured for releasably securing said coupler;

wherein an outer surface of at least a first one of said at least two rigid support arms forms a continuous surface with an outer surface of at least a second one of said at least two rigid support arms, said continuous surface free of projections when each of said first and second one of said at least two rigid support arms is in a compact position.

10. A portable carrying device, comprising:

a housing sized to fit within a pocket, said housing having at least two recesses configured for receiving at least two rigid support arms configured to be movably extendable to rigidly project from a lower portion of said housing opposed from said upper portion when in a first position, and returned to a second position in which said rigid support arms are not extended from said housing, at least a portion of each of said rigid support arms having a curved section extending generally toward an upper of said housing when said rigid support arms are in said first position, each of said rigid support arms having a shape conforming to a respective recess of said at least two recesses;

an elongated flexible strap retractably extendable from an upper portion of said housing;

a coupler disposed on a first end of said elongated flexible strap;

a mating structure disposed on said upper portion of said housing and configured for releasably securing said coupler to said housing;

wherein outer surfaces of said at least two rigid support arms are substantially continuous with an outer surface of said housing when said at least two rigid support arms are disposed within said at least two recesses, whereby said outer surfaces of said at least two rigid support arms and said outer surface of said housing form a combined outer surface of said portable carrying device that is free of projections.

11. A portable carrying device, comprising:

a housing sized to fit within a packet, said housing having at least two recesses having L-shapes, each recess of said at least two recesses is configured for receiving a rigid support arm of at least two rigid support arms having L-shapes corresponding to said at least two recesses, each rigid support arm of said at least two rigid support arms movably attached to said housing and configured for supporting and securing an article to be carried thereon;

an elongated flexible strap retractably extendable from within said housing and having two opposing ends;

a coupler disposed on a first one of said two opposing ends of said elongated flexible strap;

a retractor disposed within said housing and secured to a second one of said two opposing ends of said elongated flexible strap; and a mating structure disposed on a portion of said housing and configured for releasably securing said coupler to said housing;

wherein (a) each rigid support arm of said at least two rigid support arms is movable from a first position in which said rigid support arm is compactly stored relative to said housing to a second position in which said rigid support arm is at least partially extended away from said housing and configured for receiving an article to be carried thereon, and (b) outer surfaces of said at least two rigid support arms form a substantially continuous surface with an outer surface of said housing when said at least two rigid support arms are in compact positions, said outer surfaces of said at least two rigid support arms and said outer surface of said housing form a combined outer surface of said portable carrying device that is free of projections.

* * * * *